US008257555B2

(12) United States Patent
Inoue et al.

(10) Patent No.: US 8,257,555 B2
(45) Date of Patent: Sep. 4, 2012

(54) CARRIER BELT FOR WET PAPER WEB

(75) Inventors: Kenji Inoue, Tokyo (JP); Takeshi Sawada, Tokyo (JP)

(73) Assignee: Ichikawa Co., Ltd., Tokyo (JP)

( * ) Notice: Subject to any disclaimer, the term of this patent is extended or adjusted under 35 U.S.C. 154(b) by 200 days.

(21) Appl. No.: 12/743,639

(22) PCT Filed: Nov. 7, 2008

(86) PCT No.: PCT/JP2008/070728

§ 371 (c)(1),
(2), (4) Date: Jul. 8, 2010

(87) PCT Pub. No.: WO2009/066615

PCT Pub. Date: May 28, 2009

(65) Prior Publication Data

US 2010/0319869 A1 Dec. 23, 2010

(30) Foreign Application Priority Data

Nov. 20, 2007 (JP) ..... 2007-300169

(51) Int. Cl.
*D21G 9/00* (2006.01)

(52) U.S. Cl. ..... 162/289

(58) Field of Classification Search ..... 162/289, 162/306, 358.2, 358.1, 900–903; 442/118, 442/153

See application file for complete search history.

(56) References Cited

U.S. PATENT DOCUMENTS

| | | | | |
|---|---|---|---|---|
| 5,549,967 | A | 8/1996 | Gstrein et al. | |
| 6,207,726 | B1 | 3/2001 | Spindler et al. | |
| 6,319,365 | B1 | 11/2001 | Inoue | |
| 2002/0137416 | A1 * | 9/2002 | Hagfors et al. | 442/118 |
| 2004/0065528 | A1 * | 4/2004 | Inoue | 198/699.1 |
| 2004/0185729 | A1 | 9/2004 | Inoue | |
| 2009/0095433 | A1 | 4/2009 | Inoue | |

FOREIGN PATENT DOCUMENTS

| | | |
|---|---|---|
| DE | 198 03 493 C1 | 4/1999 |
| JP | 3104995 A | 5/1991 |
| JP | 89990/2001 | 4/2001 |
| JP | 277971/2004 | 10/2004 |

* cited by examiner

*Primary Examiner* — Mark Halpern
(74) *Attorney, Agent, or Firm* — Howson & Howson LLP

(57) ABSTRACT

A wet paper web transfer belt 10 comprises a wet paper web side layer 20 having hydrophilic fibers 41 and a machine side layer 23. The machine side layer 23 is a batt layer having a core-sheath conjugate fiber comprising a core member made of nylon with a high melting point and a sheath member made of nylon with a lower melting point than the core member, and said machine side layer has a fused layer of the sheath member on the surface thereof.

6 Claims, 5 Drawing Sheets

CARRIER BELT FOR WET PAPER WEB

CROSS-REFERENCE TO RELATED APPLICATIONS

This application is a national stage of International Patent Application No. PCT/JP2008/070728, filed Nov. 7, 2008, which claims priority of Japanese Patent Application No. 2007-300169, filed Nov. 20, 2007.

FIELD OF THE INVENTION

This invention relates to a wet paper web transfer belt (hereinafter also referred to as a "belt"), and specifically to a belt for transferring a wet paper web at high speed.

BACKGROUND ART

Recently, closed-draw-type papermaking machines having no open draw section have been developed to speed up papermaking operation.

A typical closed draw papermaking machine is shown in FIG. 5.

A wet paper web WW, shown in a broken line in the figure, is transferred from the right to the left, being supported by press felts PF1, PF2, a wet paper web transfer belt TB, and a dryer fabric DF. The press felts PF1, PF2, the wet paper web transfer belt TB, and the dryer fabric DF are, as is generally known, endless belts and held by guide rollers GR. A shoe PS has a concave bottom which conforms to the press roll PR. The shoe PS and the press roll PR, with a shoe press belt SB in-between, compose a press part PP.

The wet paper web WW, after traveling through a wire section and a first press part (not shown in the figure), is transferred from the press felt 1 onto the press felt 2. It is then transferred to the press part PP by the press felt 2, where the wet paper web WW, sandwiched between the press felt PF2 and the wet paper web transfer belt TB, is compressed by the shoe PS and the press roll PR with the shoe press belt SB in-between.

The press felt PF2 has a high water permeability, whereas the wet paper web transfer belt TB has a very low permeability. Accordingly, within the press part PP, the water contained in the wet paper web WW moves into the press felt PF2. The press felt PF2, the wet paper web WW, and the wet paper web transfer belt TB, rapidly released from the compression upon leaving the press part PP, back to their uncompressed state. This expansion of the volume, coupled with the capillary phenomenon of the pulp fibers composing the wet paper web, causes rewetting in which some of the water within the press felt PF2 backs to the wet paper web WW. However, the wet paper web transfer belt TB does not hold water therein because of its low permeability. Thus, the wet paper web transfer belt TB causes little or no rewetting and hence facilitates dewatering of the wet paper web. The wet paper web WW, after exiting the press part PP, is transferred by the wet paper web transfer belt TB. The wet paper web WW is then sucked onto a suction roll SR and a dryer fabric DF transfers it to a drying section.

The wet paper web transfer belt TB is required to have a function to allow smooth detachment (paper release) of the wet paper web WW when it transfers it to the next process.

Unexamined Japanese Patent Publication No. 89990/2001 discloses an example of the wet paper web transfer belt with such a function, in which a paper side layer comprises a high molecular weight elastic section and a fiber body, either of which is made from a hydrophobic material. According to this invention, the hydrophobic material breaks a thin water film formed between the wet paper web and the wet paper web transfer belt, after the wet paper web travels out of the press section, which enables smooth transfer of the wet paper web to the next process.

On the other hand, another important consideration has become increasingly recognized that the wet paper web transfer belt should be capable of having the wet paper web attached securely thereon at the exit of the press section.

While the wet paper web transfer belt disclosed in the Unexamined Patent Publication No. 89990/2001 is capable of having the wet paper web detached smoothly therefrom, it has a problem that the paper web sometimes gets torn during and at the time of transferring to the next process, because the thin water film between the wet paper web and the belt is broken at the exit of the press section, where the wet paper web does not securely stick to the surface of the belt.

With the object to solve this problem, the inventor of the present invention proposed, in Unexamined Japanese Patent Publication No. 277971/2004, a wet paper web transfer belt with a paper side layer which comprises a high molecular weight elastic section and a fiber body, a part of the fiber body being exposed on the surface of the belt. According to this invention, since hydrophilic fibers exposed on the surface of the paper side layer holds the water removed from the wet paper web, the belt is provided with a balanced combination of functions to transfer the wet paper web attached thereon and to allow smooth detachment of the paper web when transferring it to the next process.

The machine side layer of the wet paper web transfer belt of the Unexamined Patent Publication No. 277971/2004 is a batt layer made of staple fibers. However, since this type of machine side layers are subjected to high frictional resistance, the batt fibers on the surface of the machine side layer tend to get worn in a shorter period of time due to friction, as the wet paper web transfer belt runs around the press section and guide rollers of the papermaking machine; a problem recognized by those skilled in the art.

Wear-resistant property has been required to machine side layers, because the machine side layer of a wet paper web transfer belt acts as a cushion of the belt and serves to maintain dimensional stability of the belt by protecting a base body of the belt.

Therefore, it is an object of the present invention to provide a wet paper web transfer belt having a low-friction and less-wearing machine side layer.

DISCLOSURE OF THE INVENTION

The present invention solved the above-mentioned problem by a wet paper web transfer belt for use in a press section of a closed-draw-type papermaking machine, comprising a base body, a wet paper web side, and a machine side, said wet paper web side layer comprising a wet paper web contacting side batt layer having hydrophilic fibers and a base body side batt layer, at least said wet paper web contacting side batt layer being impregnated with high-molecular-weight elastic body, at least a part of said hydrophilic fibers are exposed on the surface of the wet paper web contacting side batt layer, characterized in that said machine side is a batt layer having a core-sheath conjugate fiber comprising a core member made of nylon with a high melting point and a sheath member made of nylon with a lower melting point than the core member, and said machine side layer has a fused layer of the sheath member on the surface thereof.

The wet paper web transfer belt of the present invention effectively maintains cushioning characteristics and dimensional stability, because the machine side layer has a fused layer on its surface, thereby reducing frictional wear of the machine side layer.

PREFERRED EMBODIMENTS OF THE INVENTION

The wet paper web transfer belt of this invention is to be detailed hereafter.

Figure 1:
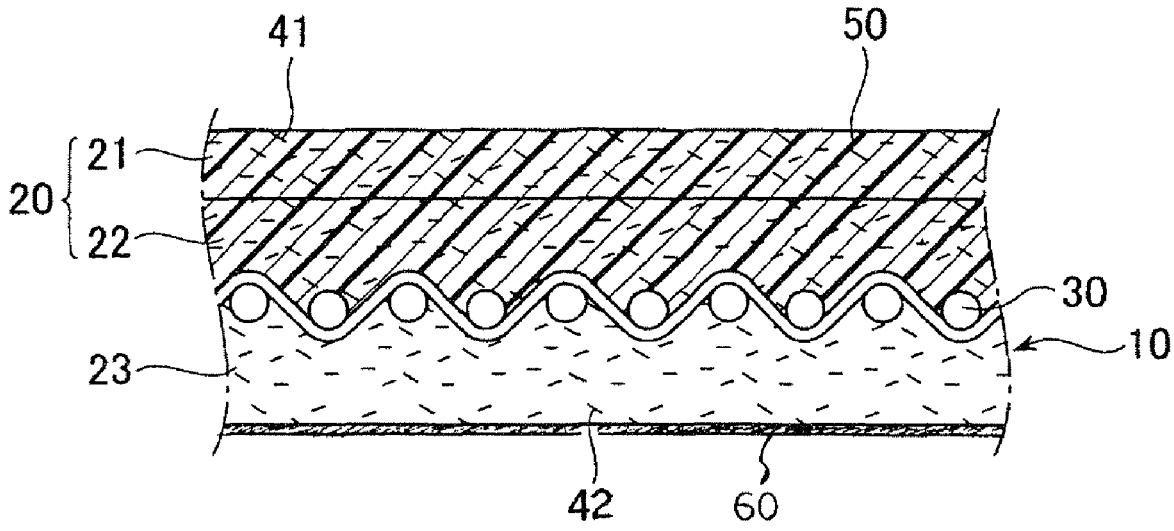
FIG. 1 is a CMD cross-sectional schematic view of a first embodiment of the wet paper web transfer belt of the present invention.
Figure 2:
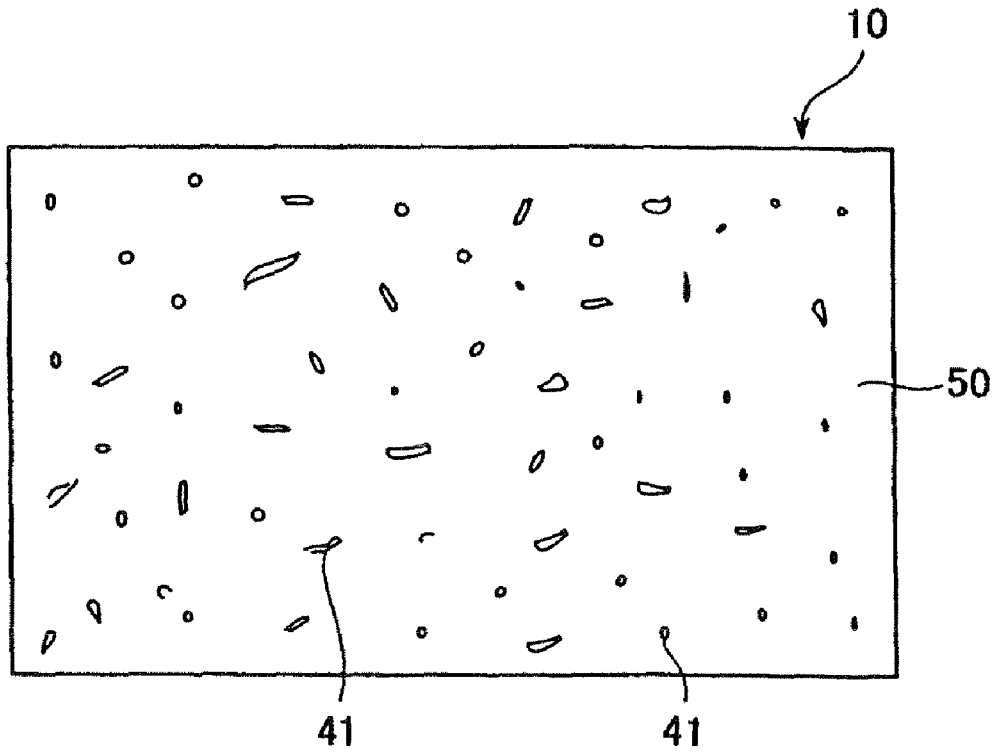
FIG. 2 is a schematic plan view of the surface of a wet paper web side of the wet paper web transfer belt of the present invention.
Figure 4:
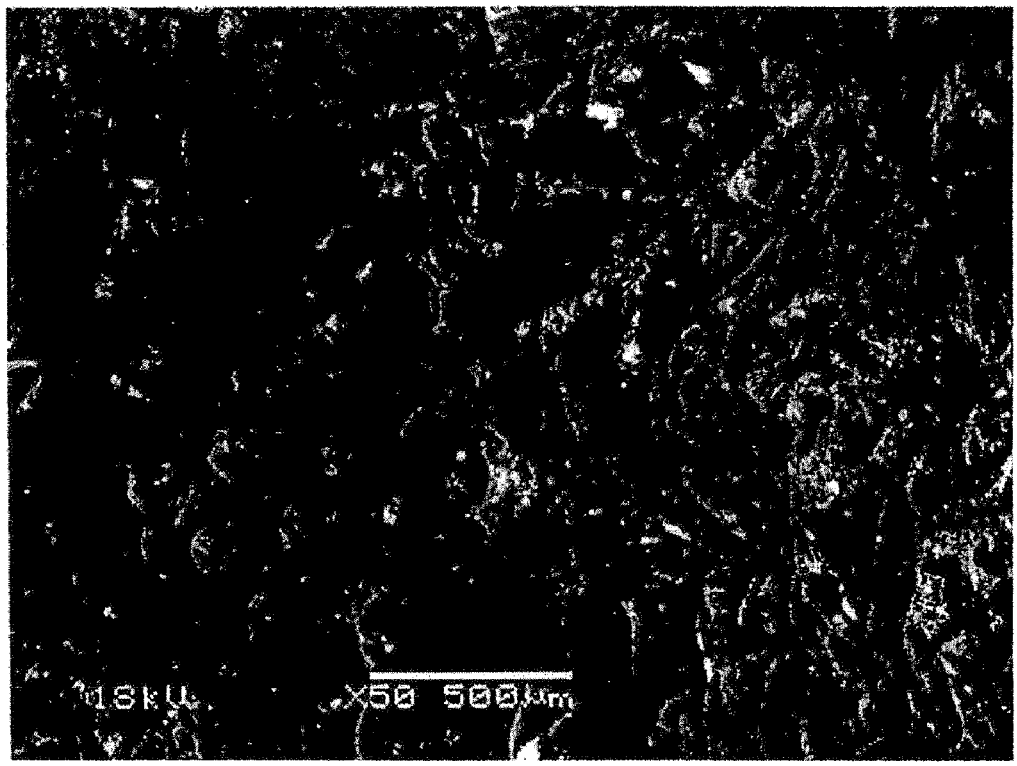
FIG. 4 is a plan view of the surface of a machine side of the wet paper web transfer belt of the present invention.
Figure 5:
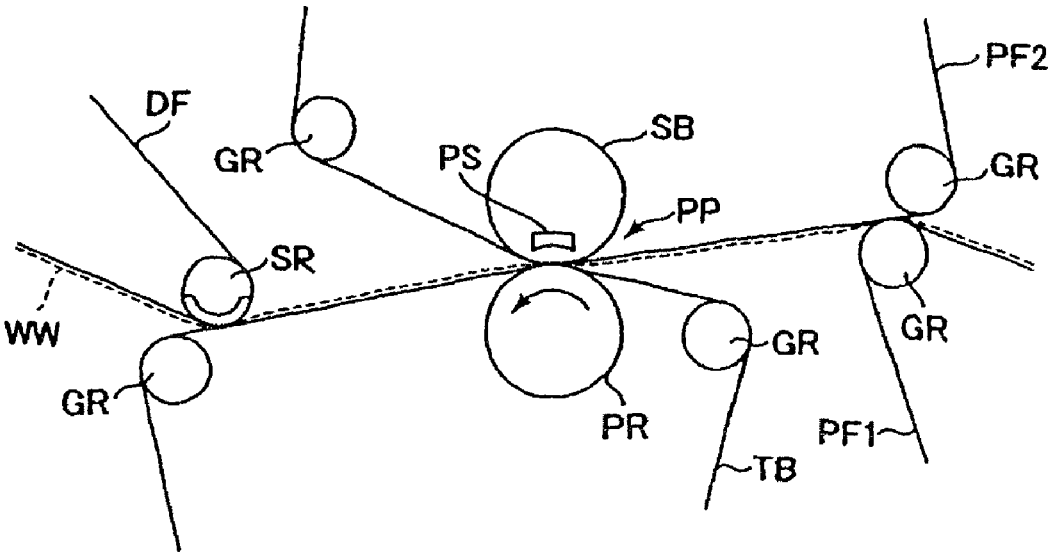
FIG. 5 is a schematic view of a typical closed draw papermaking machine.

FIG. 1 is a CMD cross-sectional view of a first embodiment of the wet paper web transfer belt of the present invention. FIG. 2 is a plan view of a wet paper web side of the belt, and FIG. 4 is a plan view of a machine side of the belt.

As shown in FIG. 1, a wet paper web transfer belt 10 comprises a base body 30, a wet paper web side layer 20, and a machine side layer 23, the wet paper web side layer 20 comprising two layers: a paper contacting side batt layer 21 and a base body side layer 22 disposed on the inside of the wet paper web contacting side batt layer 21.

The wet paper web contacting side batt layer 21 contains hydrophilic fibers 41, whereas the base body side batt layer 22 may or may not contain the hydrophilic fibers 41. The machine side layer 23 is a machine side batt layer 23 having core-sheath conjugate fibers 42 comprising a core member made of nylon with a high melting point and a sheath member with a lower melting point than the core member, having a fused layer 60 on the surface thereof which is formed by thermal fusion of the sheath member of the core-sheath conjugate fibers.

In FIG. 1, the paper contacting side batt layer 21 and the base body side batt layer 22 are impregnated with a high molecular weight elastic body 50. As illustrated in FIG. 2, the hydrophilic fibers 41 are partially exposed on the surface of the wet paper web contacting side batt layer 21. "(Being) exposed" means a state where a hydrophilic fiber 41 appears on the surface of the paper contacting side batt layer 21, regardless of whether it protrudes therefrom. Further, FIG. 2 depicts but one example of the exposure of the hydrophilic fibers 41 on the surface of the paper contacting side batt layer 21; the hydrophilic fibers 41 may take other states of exposure.

For simplicity, the wet paper web contacting side batt layer 21, the base body side batt layer 22, and the machine side layer 23 are hereinafter referred to as a "first batt layer," a "second batt layer," and a "third batt layer" respectively.

The first batt layer 21, the second batt layer 22, and the third batt layer 23 are made of staple fibers. The first batt layer 21 is a batt layer which contains staple fibers of the hydrophilic fiber 41. The first batt layer 21 may include other (staple) fibers, as long as it can maintain functions required as a wet paper web transfer belt, i.e., to transfer a wet paper web attached securely thereon and to allow smooth detachment of the wet paper web when transferring it to the next process. Examples include nylon or polyester fibers with high intensity and durability.

The second batt layer 22 and the third batt layer 23 are intertwined with the paper side and the machine side of the base body 30 respectively by means of needle punching, and the first batt layer 21 is intertwined with the second batt layer 22. Intertwining of the batt layers may be achieved by using other means including electrostatic flocking.

"Hydrophilicity" of the hydrophilic fiber 41 contained in the first batt layer 21 means such characteristics as to draw and/or hold water therein. In the present invention, "the official moisture regain" specified in JIS L0105 (general rules for physical testing method of textiles) is used as index of the "hydrophilic" characteristics.

Fibers with the official moisture regain of 8% or more are preferably used as the hydrophilic fiber 41; specifically, it can be chosen from a group of hydrophilic fibers including rayon (11.0%), polynosic (11.0%), cupra (11.0%), cotton (8.5%), hemp (12.0%), silk (12.0%), and wool (15.0%). The numbers in the parentheses are their respective official moisture regain. Fibers with the official moisture regain of less than 4% are incapable to hold water removed from the wet paper web. Thus, a wet paper web transfer belt using such fibers would become incapable of fulfilling its function to transfer the wet paper web attached securely thereon.

Fibers having a chemically-treated hydrophilic surface may also be used for the hydrophilic fiber 41. Examples include fibers processed by mercerization, resin treatment, sputtering with ionizing radiation, glow discharging and others, which are all known to those skilled in the art. During the chemical processing, the humidity should be conditioned so that the moisture content of the processed monofilament or spun yarn will be in the range of 30 to 50%, with the water contact angle less than 30 degrees, to obtain favorable results. The percentage of the water content of the monofilament or the spun yarn can be obtained by a formula, (weight of water/total weight)×100.

The first and second batt layers 21 and 22 are impregnated with a high molecular weight elastic body 50 and hardened, followed by grinding of the surface of the first batt layer 21 with a sandpaper or a grind stone, so that the hydrophilic fibers 41 are exposed on the surface of the first batt layer 21. The hydrophilic fiber 41 preferably has strength of 0.8 g/dtex or more to avoid cutoff in the process of grinding.

The second batt layer 22 is disposed on the wet paper web side of the base body 30 to provide the wet paper web transfer belt with adequate cushioning characteristics (persistent elasticity) and durability. Accordingly, the second batt layer 22 may contain the hydrophilic fiber 41 or may be made of other (staple) fibers without the hydrophilic fiber 41. Preferable examples include nylon or polyester fibers with high intensity and durability.

The third batt layer 23 is a batt layer having core-sheath conjugate fibers 42. The third batt layer 23 may include other (staple) fibers, as long as it can maintain functions required to a machine side layer, i.e., to maintain cushioning characteristics and wear resistance as the wet paper web transfer belt runs around the press section and guide rollers of a papermaking machine. Examples include nylon or polyester fibers with high intensity and durability.

Preferred nylon with a high melting point for the core member of the core-sheath conjugate fiber 42 used for the third batt layer 23 includes nylon 6, nylon 66, nylon 46, nylon 610, and nylon 612.

Nylon with a lower melting point used for the sheath member preferably includes binary copolymerized nylon such as nylon 6/12, nylon 6/610, nylon 66/6, nylon 66/12, nylon 66/610, and ternary copolymerized nylon such as nylon 6/66/12 and nylon 6/66/610.

Among them, those with a melting point of 180 degrees or less are especially preferred as nylon with a low melting point used for the present invention.

The fused layer 60 of the third batt layer 23 is formed by melting and adhesion of the sheath members during hot pressing in the manufacturing process of the wet paper web transfer belt. The surface of this fused layer 60 is dense and smooth. As shown in FIG. 4, fibers are fused together but partially maintain their configuration, thereby creating a smooth surface. The surface roughness of this fused layer 60, measured by ten-point mean roughness (Rz), is preferably in the range of 10 μm-100 μm, which enables the wet paper web transfer belt of this invention to travel around the press section and the guide rollers of a papermaking machine with low level of frictional resistance and frictional wear.

Preferably, the basis weight of the first batt layers 21 and 22 composing the wet paper web side layer 20 and the third batt layer 23 is to be set within the range of 50-600 g/m$^2$, 100-600 g/m$^2$, and 50-600 g/m$^2$ respectively.

Figure 3:
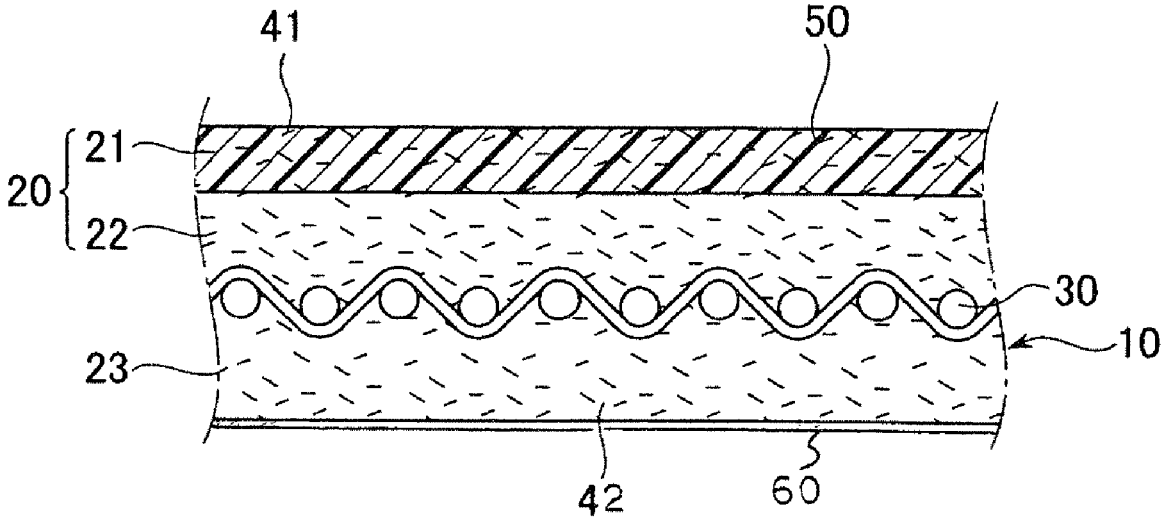
FIG. 3 is a CMD cross-sectional schematic view of a second embodiment of the wet paper web transfer belt of the present invention.

FIG. 3 is a CMD cross-sectional view of a second embodiment of the wet paper web transfer belt of the present invention. In the wet paper web transfer belt 10 of the second embodiment, only the first batt layer 21 is impregnated with the high molecular weight elastic body 50.

The compositions of the first batt layer, the second batt layer, and the third batt layer are same as in the first embodiment.

Though not shown in the drawings, in addition to the first and second embodiments, the base body 30 and the third batt layer 23 may also be impregnated with the high molecular weight elastic body 50, which means the wet paper web transfer belt 10 as a whole is impregnated with high molecular weight elastic body 50.

Materials for the high molecular weight elastic body 50 include thermosetting resin such as urethane, epoxy, and acrylic, or thermoplastic resin such as polyamide, polyarylate, and polyester.

The base body 30, as illustrated in FIGS. 1 and 3, is preferably a fabric woven with MD yarns and CMD yarns, but it is not the only possible configuration and various alternatives are available; it may be a film, a knitting, or may be formed by simply piling up MD yarns and CMD yarns without weaving or by spiraling a thin band form to make a wide band form.

Preferably the wet paper web transfer belt 10 has essentially zero air permeability. However, a certain level of air permeability may be required for some papermaking machines. In that case, a belt with desirable property can be obtained by reducing the amount of the high molecular weight elastic body, applying more intensive grinding, or employing a high molecular weight elastic body with interconnected bubbles therein.

Considering the role of the wet paper web transfer belt, however, air permeability preferably does not exceed 2 cc/cm$^2$/sec. The air permeability is measured by using A method (a Frazier type air permeability tester) specified in JIS L 1096 (testing methods for woven fabrics).

Embodiments

The wet paper web transfer belt of the present invention is to be specifically described using following embodiments. However, the scope of this invention is not limited to these embodiments.

Embodiment 1

Step 1: The base body is an endless single-woven fabric (basis weight: 400 g/m$^2$) made of nylon thread (plied with three single yarns with 500 dtex). Nylon 6 fiber (staple fiber with 20 dtex, the official moisture regain of 4.5%) and blend fiber of the core-sheath conjugate fiber (staple fiber with 20 dtex, the core member being nylon 6 and the sheath member being copolymerized nylon 6/12) and nylon 6 fiber (staple fiber with 20 dtex) in the ratio of 4 to 1 were intertwined with the base body by needle punching respectively on the wet paper web side and on the machine side of the base body (woven fabric) to form the second and the third batt layers (basis weight is both 300 g/cm$^2$).

Further, blend fiber of hydrophilic rayon fiber (staple fiber with 6 dtex, the official moisture regain of 11%) and nylon 6 fiber (staple fiber with 20 dtex) in the ratio of 4 to 1 was needle punched on the surface of the second batt layer to form the first batt layer (basis weight: 200 g/m$^2$); thus, a needle punched felt was completed.

Step 2: The needle punched felt was heated under pressure so that the core-sheath conjugate fiber of the third batt layer is melted and hardened to form a dense and smooth fused layer on the surface thereof. Hot pressing was conducted at 200 degrees C., a temperature condition sufficient to melt only the copolymerized nylon 6/12 or the sheath member.

Step 3: The needle punched felt was impregnated with the urethane resin, a high molecular weight elastic body, from the wet paper web contacting side. The felt was impregnated with the urethane resin from the center of the woven fabric to cover wet paper web side, i.e., throughout the first and second batt layers (impregnation rate: 1000 g/m$^2$).

Step 4: The urethane resin was hardened.

Step 5: The outer surface of the urethane resin was ground with a sandpaper.

Thus, a belt of Embodiment 1 was obtained with rayon fibers exposed on the surface of the wet paper web side layer.

Embodiment 2

A belt of Embodiment 2 was obtained in the same way as in Embodiment 1 explained above, except that in the step 3, only the first batt layer was impregnated with the urethane resin by using a barcoater (impregnation rate: 400 g/m$^2$).

Comparative Example 1

A belt of Comparative Example 1 is made in the same way as in Embodiment 1 explained above, except that in the step 1, nylon 6 fiber (staple fiber with 20 dtex, the official moisture regain of 4.5%) is used for the machine side of the woven fabric to form the third batt layer.

Comparative Example 2

A belt of Comparative Example 2 was obtained in the same way as in Embodiment 1 described above, except that in the step 2, only mild hot pressing (temperature condition: 140 degrees C., below the melting point of the sheath member) was applied to the felt so as not to form a fused layer on the surface of the third batt layer. It should be noted that a felt without hot pressing would also have no fused layer, and therefore would have the same structure as this example.

Following tests were conducted to evaluate performance of these wet paper web transfer belts.

1. Surface roughness of the third batt layer of the wet paper web transfer belt: ten-point mean roughness (Rz) based on JIS-B0601 was measured.
2. Wear resistance test of the surface of the third batt layer of the wet paper web transfer belt: wear resistance was determined by measuring the amount of fibers fallen off from the third batt layer, using a Taber wear tester based on JIS 1023-1992. This machine is to measure the amount of dropped fibers, with a discoidal sample placed on a rotating turntable, on which a rubber roller with high frictional resistance is applied and rotated. In this testing, the amount of dropped fibers was measured after 5000 times of rotation of the turntable.

The results of the tests are shown in Table 1.

TABLE 1

| | Surface roughness of third batt layer (μm) | Amount of dropped fibers (mg) |
|---|---|---|
| Example 1 | 30 | 100 |
| Example 2 | 30 | 110 |
| Comparative Example 1 | 100 | 200 |
| Comparative Example 2 | 90 | 190 |

As shown in Table 1, Embodiments 1 and 2 have a smooth surface on the third batt layer, and hence they are wear resistant, i.e., fewer fibers were dropped in the wear resistance test. Since the wet paper web transfer belt of the present invention has a smooth fused layer on the surface of the third layer, the machine side layer suffers less frictional wear. As a result, it advantageously reduces frictional wear of the surface of the machine side layer as the belt runs around the press section and guide rollers of a papermaking machine.

INDUSTRIAL APPLICABILITY

The wet paper web transfer belt of the present invention effectively maintains cushioning characteristics and dimensional stability, because the machine side layer has a fused layer on its surface, thereby reducing frictional wear of the machine side layer.

What is claimed is:

1. In a closed-draw-type papermaking machine, a wet paper web transfer belt in the press section of said machine, said belt comprising:

a base body, a wet paper web side layer on one side of the base body, and a machine side layer on an opposite side of the base body;

said wet paper web side layer comprising a web contacting batt layer having hydrophilic fibers and a base body side batt layer located between the web contacting batt layer and the base body;

at least said wet paper web contacting batt layer being impregnated with a high-molecular-weight elastic body;

at least a part of said hydrophilic fibers are exposed on the surface of the wet paper web contacting batt layer;

wherein said machine side layer is a batt layer having a core-sheath conjugate fiber comprising a core member made of nylon with a high melting point and a sheath member made of nylon with a lower melting point than the core member, and said machine side layer has a machine side surface and a fused layer of the sheath member on said machine side surface.

2. The wet paper web transfer belt according to claim 1, wherein said base body side batt layer is impregnated with a high-molecular-weight elastic body.

3. The wet paper web transfer belt according to claim 1, wherein said fused layer is separated from the base body by the remainder of said machine side layer.

4. The wet paper web transfer belt according to claim 1, wherein said fused layer is a fused layer formed by hot pressing.

5. The wet paper web transfer belt according to claim 1, wherein the melting point of the nylon of the sheath member is 180° C. or less.

6. The wet paper web transfer belt according to claim 1, wherein the surface roughness of the fused layer is in the range of 10 μm-100 μm Rz.

* * * * *